US005195407A

United States Patent [19]

Takeno et al.

[11] Patent Number: 5,195,407

[45] Date of Patent: Mar. 23, 1993

[54] APPARATUS FOR MAKING AN ASPHERICAL LENS AND A METHOD OF MAKING AN ASPHERICAL LENS

[75] Inventors: Nakakatsu Takeno, Inazawa; Koichi Inada; Takayuki Yokoi, both of Seki, all of Japan

[73] Assignee: Menicon Co., Ltd., Nagoya, Japan

[21] Appl. No.: 735,275

[22] Filed: Jul. 24, 1991

[30] Foreign Application Priority Data

Jul. 31, 1990 [JP] Japan ..... 2-204506

[51] Int. Cl.[5] ..... B23B 5/36

[52] U.S. Cl. ..... 82/1.11; 51/124 L; 51/284 R; 82/12; 82/118

[58] Field of Search ..... 82/1.11, 12, 118; 51/124 L, 284 R, 60, 67

[56] References Cited

U.S. PATENT DOCUMENTS

| | | | |
|---|---|---|---|
| 3,738,204 | 6/1973 | Spriggs | 82/1.11 |
| 3,909,982 | 10/1975 | Schlotfeldt | 82/12 X |
| 4,679,471 | 7/1987 | Wauchope et al. | 82/12 |
| 4,680,998 | 7/1987 | Council, Jr. | 82/1.11 |
| 4,760,672 | 8/1988 | Darcangelo et al. | 51/105 LG X |
| 4,884,482 | 12/1989 | Council, Jr. | 82/1.11 |
| 4,947,715 | 8/1990 | Council, Jr. | 82/12 X |
| 4,989,316 | 2/1991 | Logan et al. | 51/101 LG X |
| 4,995,300 | 2/1991 | Kaplan et al. | 82/12 |

FOREIGN PATENT DOCUMENTS

| | | | |
|---|---|---|---|
| 63-27813 | 2/1988 | Japan . | |
| 63-12742 | 3/1988 | Japan . | |
| 1105282 | 7/1984 | U.S.S.R. | 82/1.11 |

*Primary Examiner*—Z. R. Bilinsky

*Attorney, Agent, or Firm*—Oblon, Spivak, McClelland, Maier & Neustadt

[57] ABSTRACT

An apparatus and method for forming aspherical lenses is provided in which a holder holds and rotates a predetermined lens workpiece, with a rotation detecting device provided for detecting the rotation angle of the workpiece. The cutting bit is mounted to swing about an axis perpendicular to the axis of rotation of the workpiece holder, with the cutting bit holder also linearly reciprocated. The swing angle and linear extent of the cutting bit or cutting bit holder are also detected, such that the swinging and reciprocating movement can be coordinated and controlled. The method and apparatus is particularly advantageous in forming aspherical and irregular lens shapes.

6 Claims, 7 Drawing Sheets

APPARATUS FOR MAKING AN ASPHERICAL LENS AND A METHOD OF MAKING AN ASPHERICAL LENS

BACKGROUND OF THE INVENTION

1. Field of the Invention

This invention relates to an apparatus and a method of making an optical lens such as a contact lens or an intraocular lens having an aspherical shape such as a toric shape, a bifocal shape or a prism shape.

2. Discussion of Background

Conventionally, in the field of optics, especially a field of a lens for an eye in the eye science, an optical lens having an aspherical shape such as a toric shape, a bifocal shape or a prism shape, other than a simple spherical lens, is required for a contact lens for correction of astigmatism or the like.

As for a method of making such aspherical lens, conventional various methods have been proposed. For instance, in Japanese Examined Patent Publication No. 2742/1988, a method of making a toric shape lens is proposed, in which a roughly machined lens blank is deformed in compression (in bending) in the radial direction. Under such condition, the surface thereof is machined in a spherical shape by a cutting bit while the lens workpiece is driven to rotate around an axis. Furthermore, in Japanese Unexamined Patent Publication No. 27813/1988, the lens workpiece is driven to rotate around a plurality of rotating axes. By cutting the surface thereof in a spherical shape by a cutting bit around the respective rotation axes, a lens of a bifocal shape is produced.

However, in the former method shown in Japanese Examined Patent Publication No. 12742/1988, the lens workpiece is forcibly deformed, which applies an unfavorable influence on the lens workpiece such as strain or the like. Therefore, it is difficult to obtain a lens product of high quality. Furthermore, in the latter method shown in Japanese Unexamined Patent Publication No. 27813/1988, it is extremely difficult to control to change the rotation axis of the lens workpiece. Therefore, it is difficult to stably obtain a lens product having a required optical property, since the variation caused in the final lens shape is considerable.

Furthermore, in the specification of the U.S. Pat. No. 4,884,482, a lens workpiece is rotated around an axis by a rotating member holding the predetermined lens workpiece. The surface of the lens workpiece is cut to a desired shape, by contacting a predetermined cutting bit to the lens workpiece, and by swinging the cutting bit around an axis orthogonal to a rotation axis of the rotation member. On such occasion, a rotation angle of the rotation member and a swing angle of the cutting bit are detected. Synchronizing with the rotation angle of the rotation member, the rotation member is reciprocated toward and away from the cutting bit, by a predetermined quantity corresponding to the swing angle of the cutting bit, by which an aspherical lens is produced.

However, to obtain an economical cutting speed of the lens workpiece which is cut by the cutting bit, it is necessary to rotate the rotation member at the rotation speed of at least 1,000 r.p.m., preferably at least 3,000 r.p.m. Therefore, for instance, in making a lens of a toric shape, the rotation member should be reciprocated at the rate of at least 2,000 times/min. Therefore, it is necessary to install a driving device having extremely large output, to reciprocate the rotation member having a rotation driving mechanism, at such high rate. The control thereof is extremely difficult. The axial vibration due to the rotation is easily to be amplified by the reciprocation, which makes an accurate control difficult. Therefore, in such method of making an aspherical lens, it is not possible to obtain a sufficient productivity, and the reduction to practice thereof is extremely difficult.

SUMMARY OF THE INVENTION

It is an object of the present invention to provide an apparatus for making an aspherical lens and a method of making an aspherical lens capable of producing an aspherical lens of high quality without strain or the like, and with excellent qualitative stability and good productivity.

According to an aspect of the present invention, there is provided an apparatus for making an aspherical lens which comprises: a holder for holding a predetermined lens workpiece; a rotation member which rotatably supports the lens workpiece so that the lens workpiece can be rotated around a first axis; rotation driving means for driving to rotate the rotation member; rotation angle detecting means for detecting a rotation angle of the rotation member; a cutting bit holding member disposed opposing the holder of the rotation member, which supports a cutting bit for cutting the lens workpiece held by the holder, being possible to swing around a second axis orthogonal to a rotation shaft of the rotation member and to reciprocate toward and away from the lens workpiece; swing driving means for driving to swing the cutting bit holding member; swing angle detecting means for detecting a swing angle of the cutting bit holding member; reciprocation driving means for reciprocating the cutting bit holding member; reciprocation position detecting means for detecting a reciprocation position of the cutting bit holding member; and control means for controlling the reciprocation driving means for reciprocating the cutting bit holding member, by a predetermined quantity corresponding to the swing angle of the cutting bit holding member detected by the swing angle detecting means, in synchronism with the rotation angle detected by the rotation angle detecting means, referring to the reciprocation position of the cutting bit holding member detected by the reciprocation position detecting means.

According to another aspect of the present invention, there is provided a method of making an aspherical lens which comprises steps of: rotating a predetermined lens workpiece around a first axis; contacting a predetermined cutting bit to the lens workpiece; swinging the cutting bit around a second axis orthogonal to the first axis, thereby cutting a lens surface of the lens workpiece into a desired shape; detecting a rotation angle of the lens workpiece and a swing angle of the cutting bit; and reciprocating the cutting bit toward and away from the lens workpiece, by a predetermined quantity corresponding to the swing angle, in synchronism with the rotation angel of the lens workpiece.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 9 and 10 are diagrams showing the other embodiments of aspherical lenses favorably produced by the apparatus for making an aspherical lens shown in FIG. 1, wherein FIG. 9 is a perspective view showing an aspherical lens of a bifocal shape, and FIG. 10 is a side view showing an aspherical lens of a prism shape.

DETAILED DESCRIPTION OF THE PREFERRED EMBODIMENTS

Figure 1:
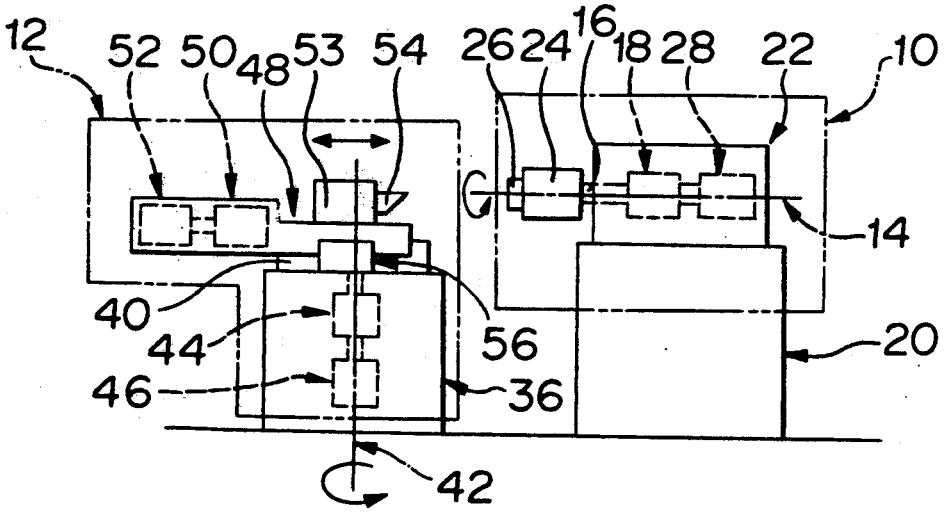
FIG. 1 is an explanatory diagram generally showing a construction of an embodiment of an apparatus for making an aspherical lens according to the present invention.

Detailed explanation will be given to the embodiments of the present invention to clarify concretely the present invention, referring to the drawings. Explanation will be given to these embodiments showing an embodiment of an apparatus for making an aspherical lens according to the present invention, and an embodiment of a method of making an aspherical lens according to the present invention by using the apparatus thereof.

First of all, an outline structure of the apparatus for making an aspherical lens according to the present invention, is shown in FIG. 1. The apparatus of making an aspherical lens according to the present invention is composed of the rotating motion unit 10 and the reciprocating motion unit 12.

In such rotating motion unit 10, the rotation shaft 16 as a rotation element is supported rotatably around an axis, and unmovably in the axial direction and in a direction orthogonal to the axis. The rotation shaft 16 is driven to rotate around the rotation center (axis) by the rotation driving motor 18 as a rotation driving means. The chuck 24 is provided at a side end of the rotation shaft 16 in the axial direction. The lens workpiece 26 as a machined object is fixably supported by the chuck 24.

Figure 2:
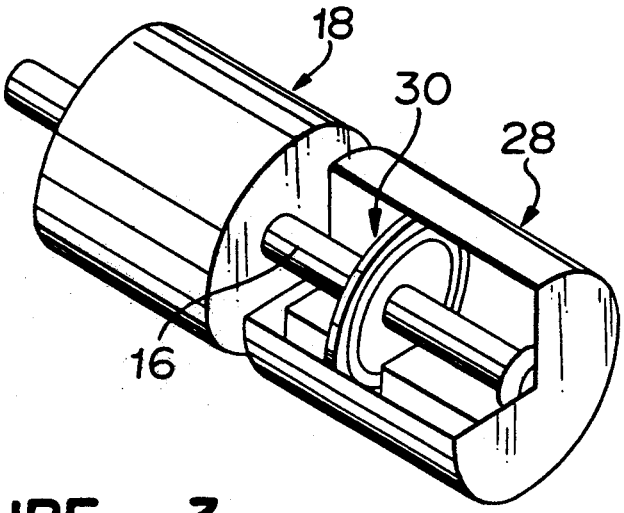
FIG. 2 is a partially cutaway perspective view showing a rotation angle detecting device favorably utilized in the apparatus for making an aspherical lens shown in FIG. 1.
Figure 3:
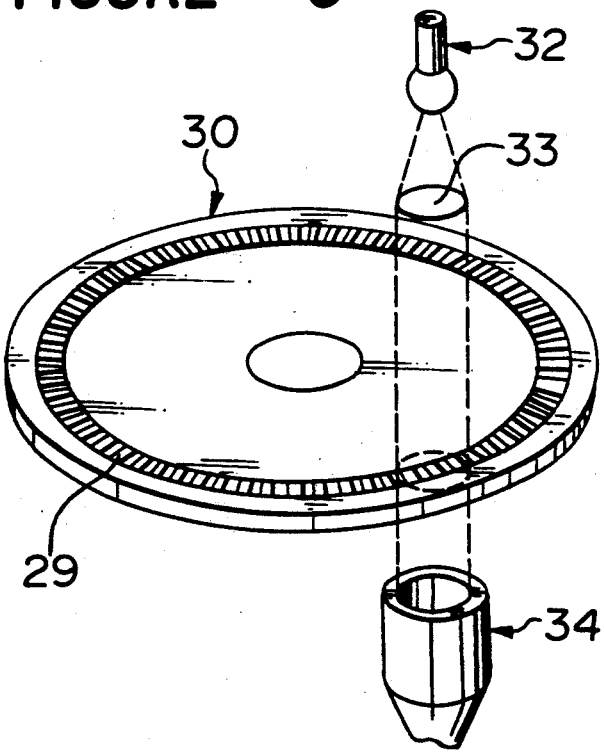
FIG. 3 is an explanatory diagram explaining an operation principle of the rotation angle detection device.

Furthermore, in this rotating motion unit 10, the rotation angle detecting device 28 is provided to detect the rotation angle of the rotation shaft 16. As shown in FIGS. 2 and 3, as the rotation angle detecting device a so-called photoelectric rotation sensor is utilized, which is composed of the disk 30 in which a great number of the equally spaced slits 29 are formed at the outer periphery, the light source 32 such as light emitting diode or the like and the photoelectric element 34 such as a photodiode or the like, which are respectively arranged on the both sides of the disk 30. In FIG. 3, a reference numeral 33 is a lens which makes a light from the light source 32 a parallel ray. As publicly known, in such rotation angle detecting device 28, two sinusoidal signals are detected, having a quarter period phase difference, by the photoelectric element 34, caused by the light from the light source 32 transmitted through the slits 29 provided at the disk 30. By treating these sinusoidal signals by a wave form shaping by which pulse signals are obtained, the rotation angle (angular position) and the rotation direction of the rotating shaft 16 can be detected based on the pulse signals.

On the other hand, as shown in FIG. 1, in the reciprocating motion unit 12, the swing bed 40 is provided, on the base 36, disposed opposing the base 20 of the rotating motion unit 10 apart at a predetermined distance, supported being possible to swing around the swing center 42 which is orthogonal to the rotation center 14 of the rotating shaft 16 in the rotating motion unit 10. As for the swing bed 40 of the embodiment, an allowable swing angle is set for swinging it in the range of 180° total, or 90° for respective sides of an angular position at which a guide rail, not shown, which guides the tool post 48, mentioned later, is extended in parallel to the rotation center 14 of the rotating shaft 16 in the aforementioned rotating motion unit 10.

The swing bed 40 can be driven to swing around the swing center 42 by the swing driving motor 44 as a swing driving means, and the swing angle (angular position) thereof can be detected by the swing angle detecting device 46.

Furthermore, as for the swing angle detecting device 46, a photoelectric type rotation sensor or the like similar to the rotation angle detecting device 28, can favorably be utilized.

Furthermore, the tool post 48 is provided on the swing bed 40, which is supported reciprocally, in a predetermined distance, in a direction orthogonal to the swing center 42. The tool post 48 can be reciprocated along the guide rail by the reciprocation driving motor 50, as a reciprocation driving means, through a worm gear mechanism or the like. The position of the tool post in the reciprocating direction, can be detected by the first reciprocation position detecting device 52, as a reciprocation position detecting means. The first reciprocation position detecting device 52 directly detects the rotation quantity of a rotating shaft of the reciprocation driving motor 50, by which a reciprocation position of the tool post 48 is indirectly detected. For instance, a photoelectric type rotation sensor or the like similar to the rotation angle detecting device 28, is favorably utilized.

Figure 4:
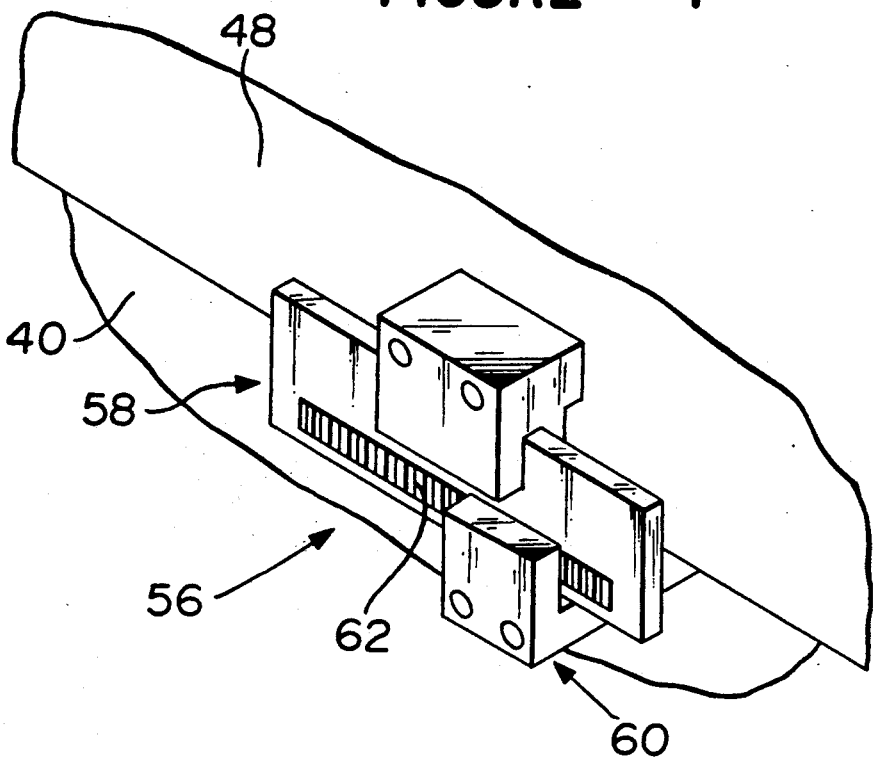
FIG. 4 is a perspective view showing a reciprocation position detecting means favorably utilized in the apparatus for making an aspherical lens shown in FIG. 1.

In the reciprocating motion unit 12 of this embodiment, in addition to the first reciprocation position detecting device 52 which indirectly detects the reciprocation position of the tool post 48 from the rotation quantity of a rotating shaft of the reciprocation driving motor 50, mentioned above, as a second reciprocation position detecting means which detects the reciprocation position of the tool post 48, the second reciprocation position detecting device 56 is provided, which is installed between the tool post 48 and the swing bed 40, and which can directly detect a relative moving quantity of the tool post 48 with respect to the swing bed 40. As shown in FIG. 4, as such second reciprocation position detecting device 56, a so-called linear type photoelectric sensor is utilized, which is composed of the rectangular plate 58 in which a great number of the equally spaced slits 62 are provided in the moving direction of the tool post 48, and the detector 60 having a light source and a photoelectric element (not shown) which are fixed to the swing bed 40, and which are disposed at both sides of the rectangular plate 58. Furthermore, similar to the photoelectric type rotation sensor utilized as the rotation angle detecting device 28 or the like, the reciprocation position is directly detected with respect to the swing bed of the tool post 48, based on the pulse signal obtained by treating by a wave form shaping of the sinusoidal signals detected by the detector 60.

The cutting bit 54 is fixably attached to the tool post 48 which is possible to swing around the swing center 42 on the base 36, and which is reciprocally supported in the longitudinal direction of the guide rail extended in the direction orthogonal to the swing center 42, by the tool holder 53.

Furthermore, a tip of such cutting bit 54, is arranged opposing the lens workpiece 26 held by the chuck 24 provided at the rotation shaft 16 of the rotating motion unit 10, on the rotation center 14 of the rotating shaft 16. By the reciprocation of the tool post 48, the tip of the cutting bit 54, can move toward and away from the lens workpiece 26. The tip of the cutting bit 54 can be displaced on the lens workpiece 26 in the direction orthogonal to the shaft (radial direction), by a swing motion around the swing center 42 of the tool post 48.

Figure 5:
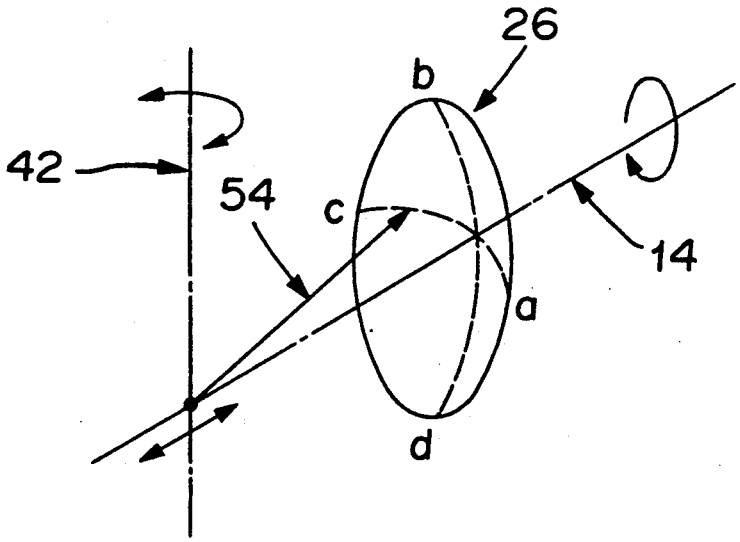
FIG. 5 is a model diagram showing the cutting process of lens in the apparatus for making an aspherical lens shown in FIG. 1.

Accordingly, in such a device, as shown in FIG. 5 as a model diagram, the lens workpiece 26 held by the rotating shaft 16 in the rotating motion unit 10, is rotated around the rotation center 14, whereas the cutting bit 54 is swung around the swing center 42 while contacting the lens workpiece 26, by which the convex side of such lens workpiece 26 can be cut over the whole area thereof. Furthermore, in such machining operation, a lens having a target curved shape can be cut by moving the cutting bit 54 toward and away from the lens workpiece 26, so that the tip of the cutting bit 54 can be moved on the locus along the target lens shape.

Figure 6:
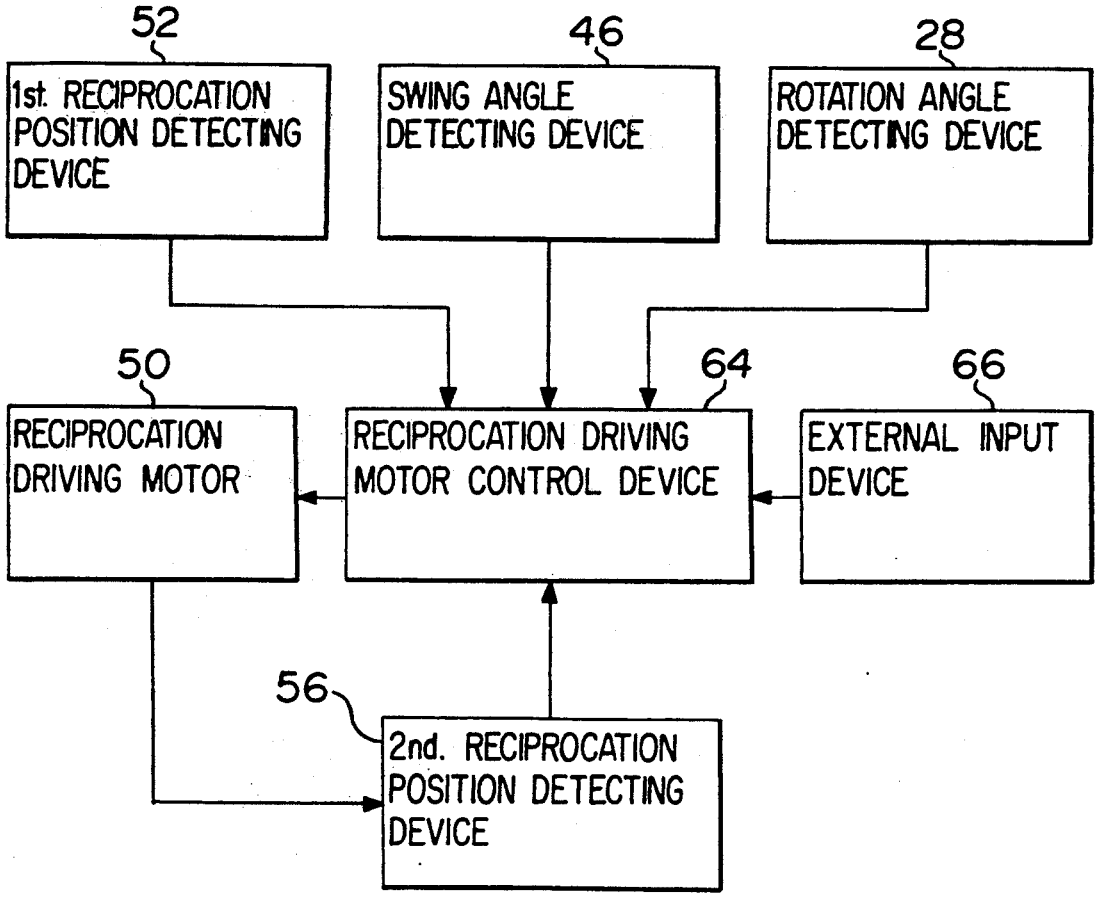
FIG. 6 is a block diagram showing a control method of a reciprocation driving means in the apparatus for making an aspherical lens shown in FIG. 1.

For explaining more in details, in this embodiment, as shown in FIG. 6, data of the target lens shape is inputted from the external input device 66, to the control device 64 of the reciprocation driving motor 50 which drives the tool post 48. As the inputs to the control device 64, the rotation angle signal of the rotating shaft 16 which holds the lens workpiece 26, which is detected by the rotation angle detecting device 28, the swing angle signal of the tool post 48 which holds the cutting bit 54, which is detected by the swing angle detecting device 46, and the reciprocation position signal of the tool post 48 which holds the cutting bit 54, which is detected by the first reciprocation position detecting device 52, are respectively inputted to the control device 64.

Furthermore, by such control device 64, the contact position of the cutting bit 54 on the lens workpiece 26, is obtained, based on the rotation angle signal of the rotating shaft 16 which is inputted from the rotation angle detecting device 28, and the swing angle signal of the tool post 48, which is inputted from the swing angle detecting device 46. Furthermore, based on the input data from the external input device 66, the cutting quantity for the lens workpiece at the contact place for obtaining the target lens shape, that is, the target distance between the tool post 48 which holds the cutting bit 54, and the lens workpiece 26, is obtained. On the other hand, the obtained target distance is compared with the current distance between the tool post 48 and the lens workpiece 26, which is obtained by the position signal of the tool post 48, which is inputted from the first reciprocation position detecting device 52. Accordingly, the signal which drives the tool post 48 toward and away from the lens workpiece 26, by the difference between the target distance and the current distance, is outputted to the reciprocation driving motor 50.

Furthermore, in a control mechanism of this embodiment, when the tool post 48 is reciprocated by operating the reciprocating motor 60, based on the output signal of the control device 64 of the reciprocation driving motor, the actual moving quantity of the tool post 48, can be detected by the second reciprocation position detecting device 56. The detected signal is inputted to the control device 64 of the reciprocation driving motor. By comparing the actual moving quantity of the tool post 48 which is inputted from the second reciprocation position detecting device 56, with the target moving quantity for moving the tool post 48, which is obtained from the reciprocation driving motor control device 64, a feed back control for correcting the error is performed.

Furthermore, in such control mechanism, since a structure which directly detects the rotation quantity for the reciprocation driving motor 50, is utilized, as the first reciprocation position detecting device 52 for determining the target value for the moving quantity of the tool post 48, the reciprocation motion control of the tool post 48 can be performed with excellent response speed following the change of the rotation angle or the like of the rotating shaft 16. Furthermore, since a structure which directly detects the moving quantity of the tool post 48, is utilized, as the second reciprocation position detecting device 56 for performing the feed back control of the moving quantity of the tool post 48, the feed back control of the reciprocation quantity of the tool post 48, may be performed with high accuracy.

Figure 7:
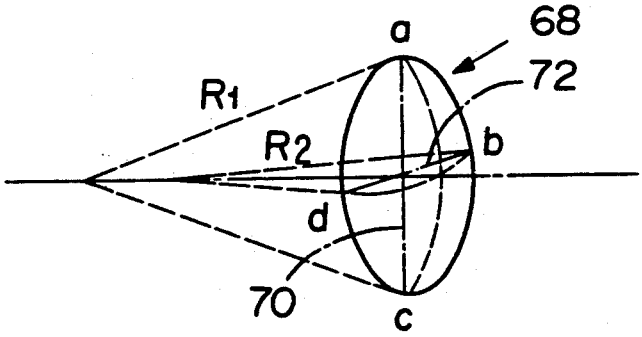
FIG. 7 is the perspective view showing a lens of a toric shape favorably produced by the apparatus for making an aspherical lens shown in FIG. 1.

To be more concrete, as shown in FIG. 7, in order to make an aspherical lens 68 of a so-called toric shape, by setting different radii of curvature (R1, R2) which are respectively set in the direction of the first meridian 70 (a-c) and in the direction of the second meridian 72 (b-d), which are orthogonal to each other, by using the above apparatus, as shown in FIGS. 8*a* through 8*d* as model diagrams, when the contact position of the cutting bit 54 on the lens workpiece 26, falls at the first meridian 70, the distance between the swing center 42 of the tool post 48 which holds the cutting 54, and the lens workpiece, l1, is determined corresponding to the swing angle of the tool post 48, $\theta$, so that the cutting bit 54 is positioned on the locus having a radius of curvature of R1 in the direction of the first meridian 70. On the other hand, when the contact position of the cutting bit 54 on the lens workpiece 26 falls on the second meridian 72, the distance between the swing center 42 of the tool post 48 which holds the cutting bit 54, and the lens workpiece 26, l2, is determined corresponding to the swing angle of the tool post 48, $\theta$, so that the cutting bit 54 is positioned on the locus having the radius of curvature of R2 in the direction of the second meridian 72.

Figure 8A:
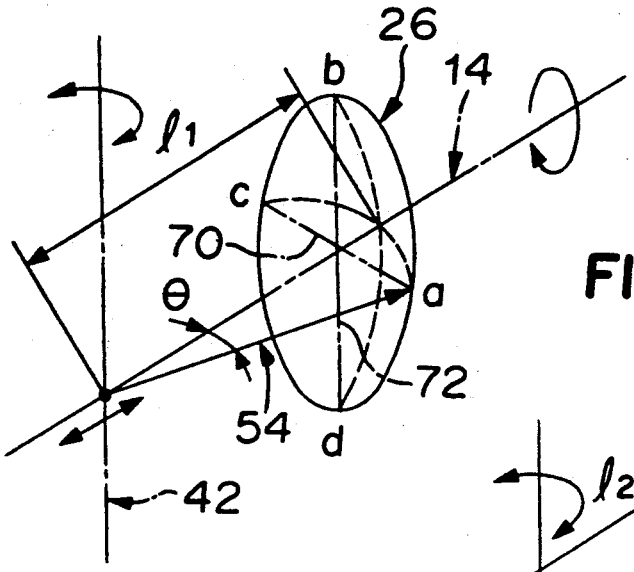
FIGS. 8*a* to 8*e* are explanatory diagrams showing a cutting process for making a lens of a toric shape using models thereof.
Figure 8B:
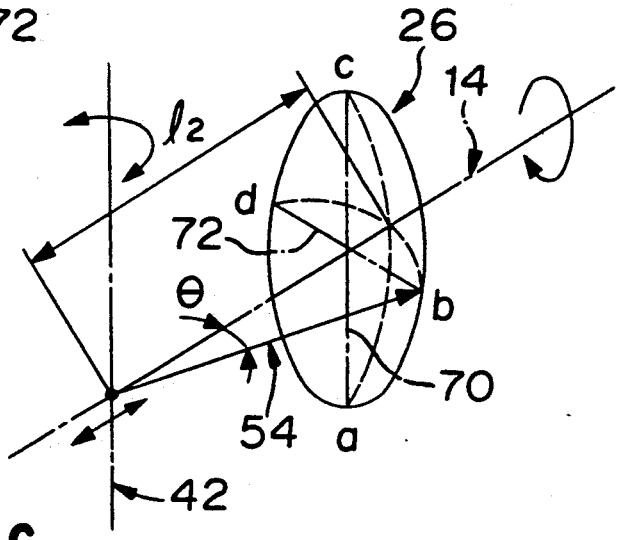
Figure 8C:
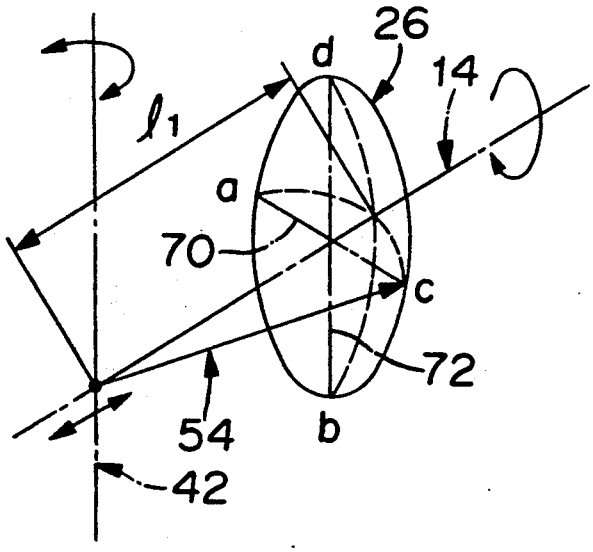
Figure 8D:
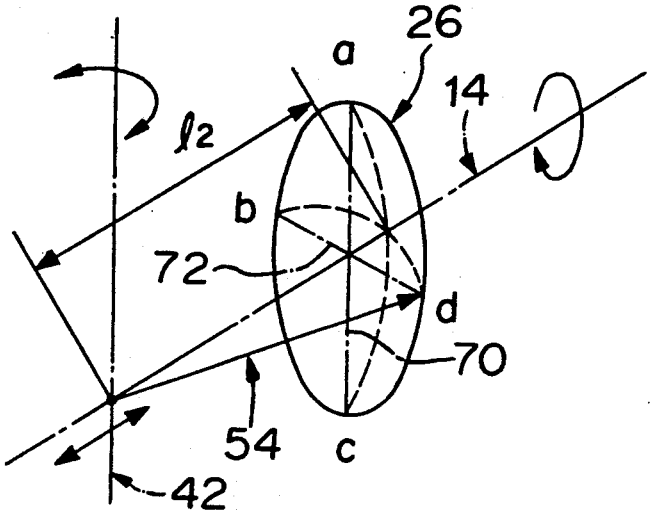
Figure 8E:
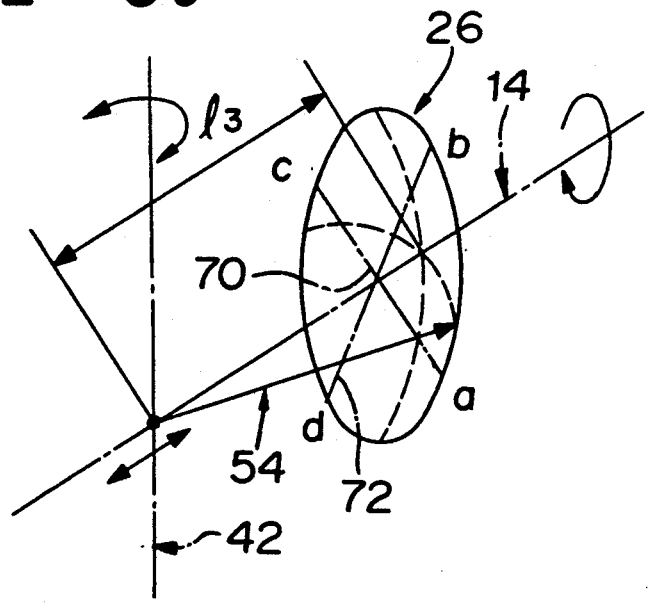

In other words, the tool post 48 which holds the cutting bit 54, is reciprocated, synchronizing with the rotation angle of the lens workpiece 26 which is rotated around the rotation center 14, in the relationship of two reciprocations per one rotation of the lens workpiece 26, on the straight line parallel with the rotation center 14, by a predetermined quantity corresponding with the swing angle around the swing center 42 of the tool post 48. Furthermore, as shown in FIG. 8*e*, at the rotation position of the lens workpiece 26 where the cutting bit 54 is contacted with the lens workpiece 26, between the first and the second meridians 70 and 72, the distance between the swing center 42 of the tool post 48, and the lens workpiece 26, l3, becomes a value between l1 and l2, and the cutting is performed with the radius of curvature the size of which is between the radii of curvatures of the first and second meridians, at the position between the first and second meridians 70 or 72, by which the aspherical lens 68 of the target toric shape can be produced.

Figure 9:
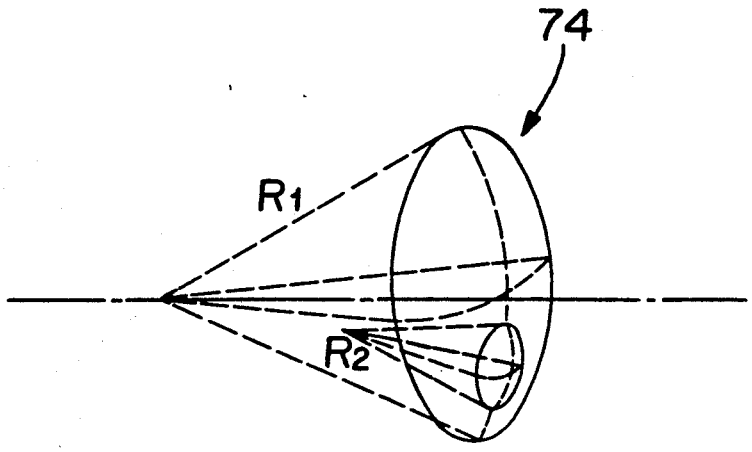
Figure 10:
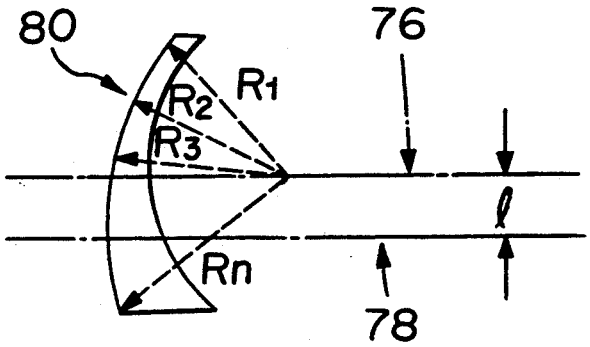

Accordingly, by such method for making a lens, a lens surface having different curvatures with respect to the circumferential direction and the radial direction of the lens workpiece 26 at the respective positions thereof, can be formed. By this means, it becomes possible to form by cutting, not only a spherical lens, but various types of aspherical lenses, such as the lens 68 of the toric shape as shown in FIG. 7, or the lens 74 of a so-called bifocal shape, having portions with two different radii of curvature (Rl, R2) in one lens as shown in FIG. 9, or as shown in FIG. 10, the lens 80 of a so-called prism shape, in which the lens center 76 is deviated from the light axis center 78 by a determined length (l), and the radius of curvature of the convex surface with respect to the lens center 76, gradually changes from Rl to Rn.

Furthermore, according to the method, since the various types of aspherical lenses can be produced without bending the lens workpiece 26, or changing the rotation center 16 of the lens workpiece 26, an aspherical lens with good quality, can favorably be produced with excellent qualitative stability.

In such a manufacturing device, by reciprocating the tool post 48, the motion (swing motion) of which is slow compared with the rotational motion of the rotating axis 16, toward and away from the lens workpiece 26, the radius of curvature of the cutting surface can be controlled. Therefore, compared with the conventional structure in which a high speed rotating shaft is reciprocated, the structure for the reciprocation motion is simple, and the control thereof is easy, and the lowering of the control accuracy due to the axial vibration by the rotation is not a problem. Therefore, in such manufacturing apparatus, the rotation speed of the rotating shaft 16 can be increased to the practical range in which an economical cutting speed is obtained, securing the cutting accuracy with respect to the lens workpiece 26, and the stability, by which it becomes possible to satisfy the economy securing sufficiently the product quality, and the reductions practice thereof can favorably obtained.

Furthermore, in the manufacturing apparatus of this embodiment, as the reciprocation position detecting means for detecting reciprocation position of the tool post 48, the first reciprocation position detecting device 62 which directly detects the motional quantity of the reciprocation driving motor 50, and the second reciprocation position detecting device 56 which directly detects the moving quantity of the tool post 48, are provided. Therefore, based on the detected value of the first reciprocation position detecting device 52, the target value of the moving quantity of the tool post 48 is determined. Furthermore, based on the detected value by the second reciprocation position detecting device 56, the moving quantity of the tool post 48 is controlled by a feed back control. Therefore, the reciprocation control of the tool post 48, is performed securing the high accuracy, and having an excellent response speed.

As mentioned above, detailed explanation is given to embodiments of the present invention. However, these embodiments are only exemplifications. Therefore, this invention should not be interpreted by limiting to these embodiments.

For instance, in the manufacturing apparatus of the above embodiments, the swing center 42 of the tool post 48 which constitutes the reciprocating motion unit 12, is set on the side of the reciprocating motion unit 12, in view of the contact position of the lens workpiece 26 and the cutting bit 54. However, it is possible to set the swing center of the tool post 48 on the side of the rotating motion unit 10, in view of the contact position of the lens workpiece 26 and the cutting bit 54.

Furthermore, it is possible to apply various driving mechanisms other than a motor, for the rotation driving means which drives to rotate the rotation member, or the swing driving means which drives to swing the tool post, or the reciprocation driving means which reciprocates the tool post, or the like. For instance, as a swing driving means, a piston mechanism or the like may be adopted, and as a reciprocation driving means, a linear motor or the like may be adopted.

Furthermore, in the manufacturing device of the above embodiments, as a reciprocation position detecting means which detects the reciprocation position of the tool post, the first and second reciprocation position detecting means 52 and 56 are provided. However, it is of course possible to control the driving of the reciprocation of the tool post, based on the detected signal of the reciprocation position detecting means, by installing only one reciprocation position detecting means.

The manufacturing method in this invention is feasible without using the manufacturing apparatus exemplified above.

Moreover, the manufacturing apparatus of an aspherical lens according to the present invention, and the manufacturing method of an aspherical lens, may favorably be utilized in making an aspherical lens in the various fields of optics, other than lenses for an eye including a contact lens and an intraocular lens.

Although not enumerated, this invention can be practiced in the other embodiments in which various alterations, modifications and improvements are added based on the knowledge of those skilled in the art. It goes without saying that these embodiments are included in the scope of this invention so far as they are not out of the gist of the present invention.

What is claimed is:

1. An apparatus for making an aspherical lens which comprises:

a holder for holding a predetermined lens workpiece;

a rotation member which rotatably supports the lens workpiece so that the lens workpiece can be rotated around a first axis;

rotation driving means for driving to rotate the rotation member;

rotation angle detecting means for detecting a rotation angle of the rotation member;

a cutting bit holding member disposed opposing the holder of the rotation member, which supports a cutting bit for cutting the lens workpiece held by the holder, wherein the cutting bit holding member is mounted to permit said holding member to swing around a second axis orthogonal to a rotation shaft of the rotation member and to reciprocate toward and away from the lens workpiece;

swing driving means for driving to said swing the cutting bit holding member;

swing angle detecting means for detecting a swing angle of the cutting bit holding member;

reciprocation driving means having a linear output for linearly reciprocating the cutting bit holding member toward and away from the lens workpiece held by said holder;

a first reciprocation position detecting means for detecting a linear extent of a reciprocation position of the cutting bit holding member; and control means for controlling the reciprocation driving means to reciprocate the cutting bit holding member by a predetermined quantity corresponding to the swing angle of the cutting bit holding member detected by the swing angle detecting means, in synchronism with the rotation angle detected by the rotation angle detecting means, and with reference to the reciprocation position of the cutting bit holding member detected by the reciprocation position detecting means.

2. The apparatus of claim 1, further including second reciprocation position detecting means, said second reciprocation detecting means detecting an actual quantity of movement of said cutting bit holding member and providing a signal to the control means, and wherein said control means compares the moving quantity detected by said second reciprocation position detecting means with a target moving quantity value for correcting error between the target moving quantity and the actual moving quantity.

3. The apparatus of claim 2, wherein the first reciprocation position detecting means comprises means for detecting a rotation quantity of a rotating shaft of the reciprocation driving means, and wherein said second reciprocation position detecting means comprises means for measuring linear movement of the cutting bit holding member.

4. An apparatus for forming lenses comprising:

a workpiece holder for holding a lens workpiece;

rotation driving means for rotating said holder;

rotation angle detecting means for detecting angular position of the holder and lens workpiece;

a cutting bit holder for holding a cutting bit, said cutting bit holder mounted to allow said cutting bit to pivot about a pivot axis orthogonal to an axis of rotation of said workpiece holder;

pivot driving means for pivoting said cutting bit holder;

pivot angle detecting means for detecting a pivot angle position of the cutting bit holder;

reciprocation driving means having a linear output for linearly reciprocating the cutting bit holder toward and away from a lens workpiece held by said workpiece holder;

reciprocation position detecting means for detecting a linear extent of a reciprocation position of the cutting bit holder; and a reciprocation driving motor control device which receives signals from said rotation angle detecting means, pivot angle detecting means, and reciprocation position detecting means, wherein said reciprocation driving motor control device causes said reciprocation driving means to move said cutting bit holder from the detected reciprocation position to a target reciprocation position, and wherein said reciprocation driving motor control device determines said target reciprocation position based upon the detected pivot angle position of the cutting bit holder and the detected rotation angle position of the holder for the lens.

5. The apparatus of claim 4, further including second reciprocation position detecting means to allow correction of errors in movement of the cutting bit holder by the reciprocation driving means.

6. A method of making an aspherical lens which comprises steps of:

rotating a predetermined lens workpiece around a first axis;

contacting a predetermined cutting bit with the lens workpiece;

swinging the cutting bit around a second axis orthogonal to the first axis, thereby cutting a lens surface of the lens workpiece into a desired shape;

detecting a rotation angle of the lens workpiece and a swing angle of the cutting bit; and linearly reciprocating the cutting bit toward and away from the lens workpiece, by a predetermined quantity corresponding to the swing angle, in synchronism with the detected rotation angle of the lens workpiece.

* * * * *